United States Patent [19]

Pettitt et al.

[11] Patent Number: 5,052,193

[45] Date of Patent: Oct. 1, 1991

[54] AIR CONDITIONING SYSTEM ACCUMULATOR

[75] Inventors: Edward D. Pettitt; Douglas C. Wintersteen, both of Burt, N.Y.

[73] Assignee: General Motors Corporation, Detroit, Mich.

[21] Appl. No.: 519,967

[22] Filed: May 7, 1990

[51] Int. Cl.[5] ..... F25B 43/00
[52] U.S. Cl. ..... 62/503; 55/463
[58] Field of Search ..... 62/503; 55/463

[56] References Cited

U.S. PATENT DOCUMENTS

| | | | |
|---|---|---|---|
| 3,938,353 | 2/1976 | Wrenn, Jr. et al. | 62/503 |
| 4,199,960 | 4/1980 | Adams et al. | 62/503 |
| 4,217,765 | 8/1980 | Ecker | 62/503 |
| 4,291,548 | 9/1981 | Livesay | 62/503 |
| 4,474,035 | 10/1984 | Amin et al. | 62/503 |

*Primary Examiner*—Ronald C. Capossela
*Attorney, Agent, or Firm*—Ronald L. Phillips

[57] ABSTRACT

An accumulator/dehydrator for a motor vehicle air conditioning system has a bleed valve that operates in parallel with a normal fixed area bleed hole to provide for increased lubricant flow to a compressor under low charge conditions.

6 Claims, 2 Drawing Sheets

AIR CONDITIONING SYSTEM ACCUMULATOR

TECHNICAL FIELD

This invention relates to air conditioning system accumulators and more particularly to the provision of an improved oil bleed therein.

BACKGROUND OF THE INVENTION

In air conditioning systems such as those used on motor vehicles, there is typically provided an accumulator between the evaporator and the compressor. The purpose of the accumulator is to trap any liquid in the system against delivery to the compressor. The accumulator is also typically provided with a desiccant for trapping any water that may have entered the system. Thus, the accumulator serves as a protective device for the compressor.

In the accumulator, there is normally provided a U-shaped return tube along with a baffle. Entering refrigerant impinges upon the baffle, and any liquid such as liquid refrigerant, water, and oil is separated out and deposits at the bottom of the accumulator while the gaseous refrigerant is permitted to pass to the compressor through an open end of the tube that is located near the ceiling of the accumulator. The above mentioned desiccant collects any water for permanent retention thereof while a bleed hole provided in the return bend of the tube near the bottom of the accumulator is operative to withdraw the liquid refrigerant and oil and return same in a vaporized form along with the refrigerant vapor passing through the tube.

Normally, there is one such oil bleed hole and it is of a fixed size (diameter) calibrated to provide a limited rate of oil bleed as discussed in more detail late r. However, it has been found that for better lubrication of the compressor under low refrigerant charge conditions, it is desirable to then somehow provide for more oil bleed to the compressor when lubricant demands are then most severe as otherwise the oil return would normally fall off under such conditions.

SUMMARY OF THE INVENTION

The present invention provides an oil bleed valve arrangement that operates to increase the oil bleed from an optimum limited rate for normal operation with decreasing refrigerant charge conditions. According to the present invention and in the preferred embodiment, the conventional oil bleed hole of a fixed diameter is retained, this hole having been calibrated such that it allows sufficient but not excessive oil return to the compressor under normal and near normal charge levels. It is important to understanding this invention that the size of this hole must normally be limited under normal or full charge conditions so that liquid refrigerant and oil does not flood the compressor and possibly cause internal damage as well as reduce air conditioning performance. And it is to this conventional bleed hole that an oil bleed valve is added that is connected in parallel therewith. The oil bleed valve operates on another bleed hole that is connected in parallel with the normal one but is of substantially larger size. And the valve is provided with an operator that normally biases the valve to close the additional bleed hole but is responsive to low refrigerant charge to open the additional bleed hole as the charge diminishes or decreases. This latter operation is accomplished by providing the valve with a spring arrangement that normally effects the valve closure and a low charge temperature sensitive operator function in the form of an expansible chamber that is sealingly filled with refrigerant vapor. As a result, the rate of expansion of this chamber is made dependent upon the refrigerant temperatures in the system. Recognizing that the system temperature will increase as the charge decreases, the chamber expansion is utilized to offset the spring bias to effect opening of the secondary oil bleed hole.

To help understand why this increase in effective oil bleed hole size has the effect of increasing oil bleed when the charge is actually low, it was discovered that under low charge conditions oil circulation will normally decrease. And it is the evaporator and the accumulator that are the two components which tend to trap oil under these low charge conditions. As the refrigerant charge reduces in the system, the oil may still pass through the evaporator but it gets caught in the accumulator. It was found that the accumulator oil retention peaks at about 50% charge loss and that as the refrigerant charge gets lower and lower, the oil then starts to get trapped in the evaporator. It was found that there are two main reasons why the oil flow to the compressor decreases under low charge conditions. Firstly, it has to do with fluid flow through an orifice. Under low charge, the pressure drop across the oil bleed hole is decreased and also the viscosity of the oil/refrigerant mixture dramatically increases, i.e., by about 100 times with about 25° Fahrenheit super heat. Both of these conditions combine to decrease the oil flow through the bleed hole. The invention stems from the recognition that a good way to increase the oil flow of low charge would be to open up the bleed hole so that more oil could pass through it but just under low charge conditions. And the addition of the oil bleed valve described above thus provides a simple solution to this problem.

It is therefore an object of this invention to provide a new and improved oil bleed system in an air conditioning system accumulator.

Another object is to provide in an air conditioning system accumulator an oil bleed valve arrangement that operates to automatically increase the oil bleed available with decreasing refrigerant charge conditions.

Another object is to provide an air conditioning system accumulator having an oil bleed valve that operates to provide a secondary oil bleed opening in parallel with the normal oil bleed hole upon a significant drop in refrigerant charge below a normal value.

Another object is to provide in an air conditioning system accumulator an oil bleed valve that is connected in parallel with a conventional oil bleed hole and is normally spring biased closed and is opened by the force of a sealed pressure chamber in response to expansion thereof as a result of the temperature of the refrigerant of the system increasing as a result of a decrease in the amount of refrigerant then operating in the system.

These and other objects, advantages and features of the present invention will be more apparent from the following description and drawing in which:

DESCRIPTION OF THE PREFERRED EMBODIMENTS

Figure 1:
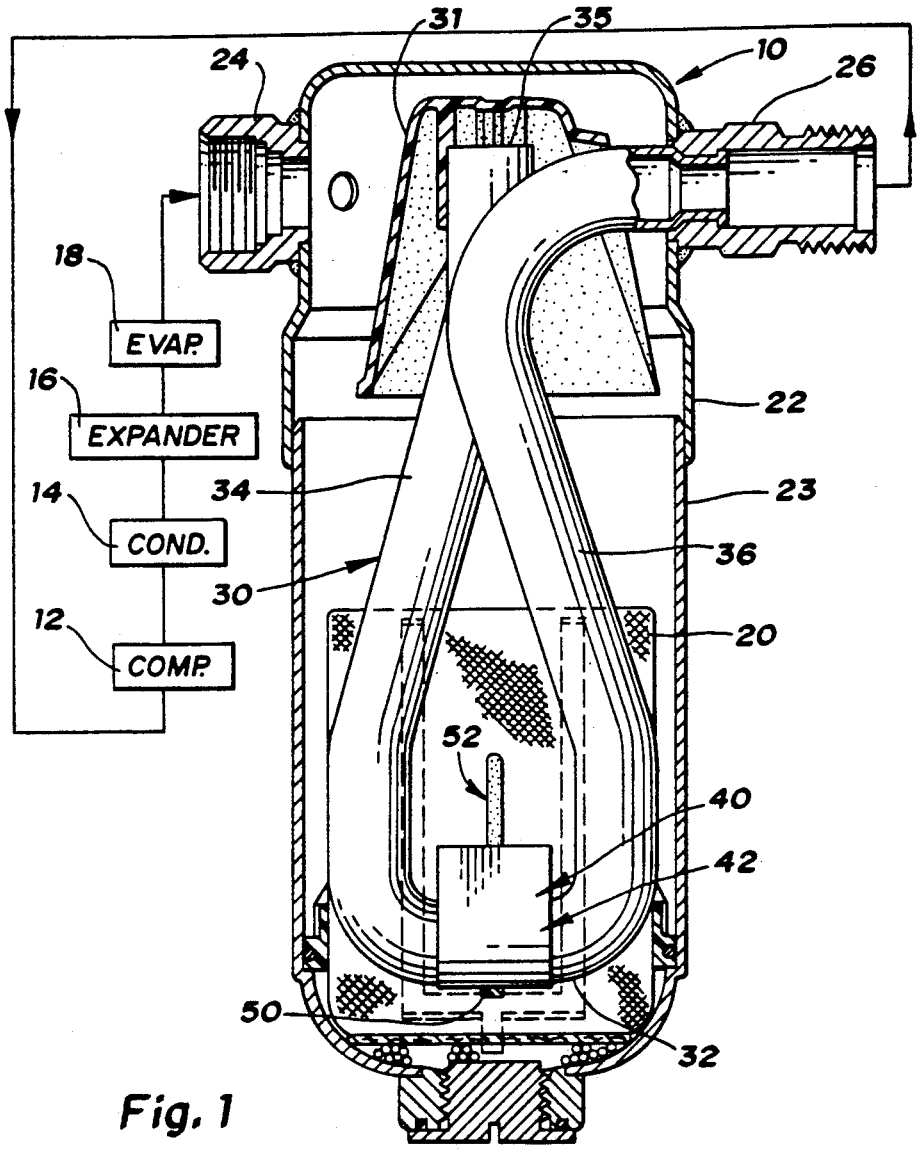
FIG. 1 is a schematic view of a motor vehicle air conditioning system with a sectional view of an accumulator/dehydrator incorporating the preferred embodiment of the present invention.

Referring to FIG. 1, there is shown an accumulator/-dehydrator 10 for a motor vehicle air conditioning system whose other components generally comprise a compressor 12, a condenser 14, an expander 16, and an evaporator 18, which are all of conventional type and are connected as shown in conventional manner as is well known in the art. As is also well known, the function of the accumulator/dehydrator is to separate liquid, including water, oil and refrigerant, from the vaporous refrigerant received from the evaporator 18 and deposit same in the bottom of the accumulator. The water is then adsorbed by a desiccant 20 stored in a bag in the bottom of the accumulator while the liquid refrigerant and oil is eventually vaporized and directed onto the compressor 12 along with the vaporous refrigerant flow passing directly through the accumulator.

The accumulator/dehydrator 10 is of the type having a permanently assembled cylindrical two part casing 22, 23 having both an inlet fitting 24 and an outlet fitting 26 by which the accumulator is connected to the line from the evaporator 18 and the line to the compressor 12, respectively Interior of the casing, there is provided a U-shaped return tube 30 and a baffle 31 of truncated conical shape which are subassembled and then secured as a unit in the casing at a single joint prior to joining of the casing portions.

Figure 2:
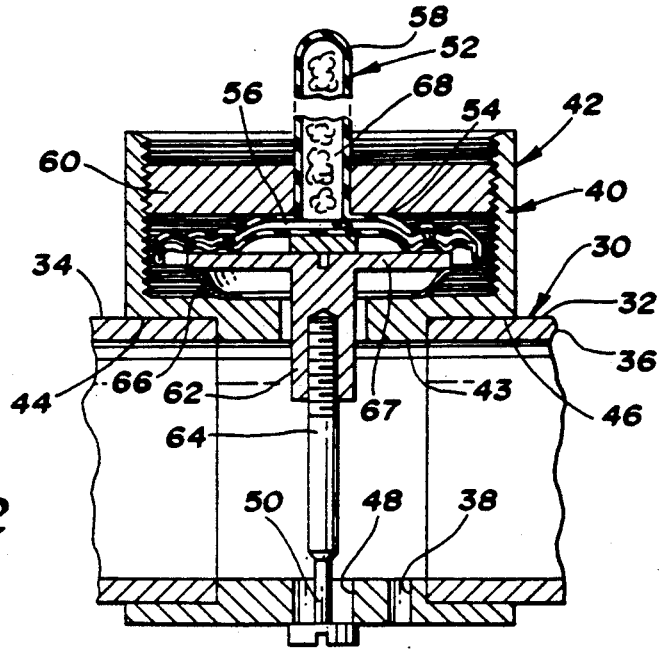
FIG. 2 is an enlarged sectional view of the oil bleed arrangement in FIG. 1.

The tube 30 has a bite or return bend portion 32 and a pair of upstanding leg portions 34 and 36. As seen in FIG. 2, the bite portion 32 has a conventional size bleed hole or port 38 through the bottom side thereof that is located adjacent to and faces the closed bottom end of the casing, while the leg portions 34 and 36 are sized to extend substantially the height of the casing. The leg portion 34 has an open end 35 located adjacent the closed upper end of the casing and the baffle 31 is pressed fitted onto this tube end while leaving same open to the interior of the casing beneath the baffle. The baffle is thus wholly supported by the tube and is interposed between the inlet fitting 24 and the open tube end so that the incoming vaporous refrigerant is caused to impinge thereon to encourage separation of the liquid components (refrigerant, oil, and/or water) and cause same to be deposited in the bottom of the casing. The other tube leg 36 has a right angle bend to its open end which is adapted to be received in and permanently connected to the outlet fitting 26, thus providing for permanent attachment between the casing, the tube and the baffle, this affixing to the upper casing portion occurring prior to joining of the lower casing portion thereto. With a suitable desiccant material such as molecular sieve stored in the bottom of the casing, the deposited water is adsorbed and retained thereby while the deposited liquid refrigerant and oil is eventually aspirated through the bleed hole 38 is vaporous form into the tube 30 where it passes along with the vaporous refrigerant already flowing therethrough and then out the fitting 26 onto the compressor 12. The accumulator/dehydrator as thus far described is of the type described in detail in U.S. Pat. No. 4,291,548 assigned to the assignee of this invention and which is hereby incorporated by reference.

As earlier mentioned, the bleed hole 38 is sized by calibration so that it allows sufficient oil return to the compressor under normal or full and near normal charge levels. The size of the bleed hole is limited so that liquid refrigerant and oil does not flood the compressor and produce adverse effects.

In the embodiment of the invention in FIGS. 1 and 2, the bleed hole 38 is formed in the housing 40 of an oil bleed valve assembly generally designated as 42 that is mounted in the bite section 32 of the return tube, The valve housing has a through bore 43 with counter bores 44 and 46 at the opposite ends thereof that receive and thereby couple the two tube portions 34 and 36 at the bite section 32 with the through bore 43 thus providing the interconnection between these tube portions. A secondary bypass bleed hole or port 48 larger in size, i.e., larger in diameter than the normal bleed hole 38, is formed in parallel relationship with the latter in the lower end of the valve housing 40. And there is provided a poppet valve 50 that is arranged with respect to the secondary bleed hole so as to open and close same, the valve being shown in the closed position in FIG. 2.

The valve 50 is operated by a power cell generally designated as 52 in the form of an expansible vapor charged pressure vessel that comprises a pair of circular annularly-corrugated metallic diaphragms 54 and 56 that are sealed along their periphery and a rigid tubular pressure vessel section 58 that extends centrally of the casing and is sealingly joined to the center of the upper diaphragm 54 and is open to the space between the two diaphragms. The pressure vessel section 58 is mounted in a disc 60 threaded in the upper end of the valve housing 40 that thus supports the pressure vessel and thereby the central portion of the upper diaphragm 54 while the lower diaphragm is connected at its center to an armature 62 to which the stem 64 of the valve 50 is threaded at its upper end. A Bellville type metal spring 66 arranged between the valve housing 40 and a shoulder 67 on the armature 62 biases the latter upward to normally close the secondary bleed port 48 with the valve 50. The two bellows 54 and 56 together with the pressure vessel portion 58 form a sealed chamber 68 that is charged with a suitable refrigerant (preferably the same as used in the air conditioning system). The charge is in the form of vapor and the pressure at which it is charged and thereafter sustained at a reference gage temperature is such that the spring will normally hold the bleed valve closed during normal full or near full charge refrigerant conditions.

In the event the charge significantly reduces for some reason (e.g. 25%) such as by leakage somewhere in the system, the temperature of the remaining vapor in the system will resultantly increase dramatically. The vapor pressure in the power cell 52 senses this temperature change in the accumulator 10 and as a result its pressure increases in proportion thereto. As this pressure increases, the force that it resultantly produces on the armature 62 opposes that of the spring 66. The calibration of the charge pressure and the spring is set so that when the charge reduces to a certain prescribed level, and there is a corresponding increase in charge temperature, the resulting gas pressure force in the power cell is sufficient to overcome the spring force to move the valve 50 downward to open the secondary bleed port. This significantly increases the oil bleed flow capacity, i.e., flow area size, thus allowing for more of the available oil in the bottom of the accumulator to be returned to the compressor than would otherwise occur through the normal fixed size oil bleed hole 38. And this increased oil bleed passage will remain available so long as the refrigerant charge remains low, i.e., the refrigerant charge temperature remains abnormally high When the refrigerant charge is eventually increased to its normal charge (i.e., recharged), the refrigerant charge temperature will correspondingly decrease to the normal level and correspondingly the temperature of the power cell will decrease accordingly allowing the spring to once again overcome the vapor pressure in the power cell and return the bleed valve to its normal closed position.

Figure 3:
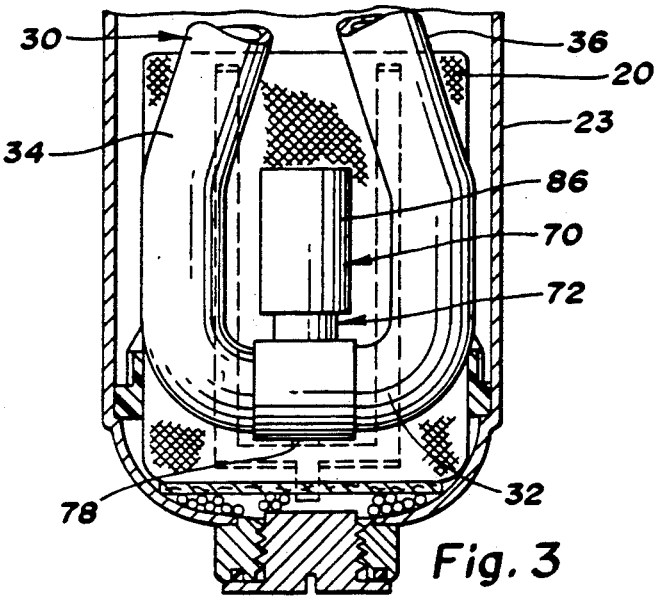
FIG. 3 is a sectional view like the lower portion of the sectional view in FIG. 1 but showing another embodiment of the oil bleed arrangement according to the present invention.
Figure 4:
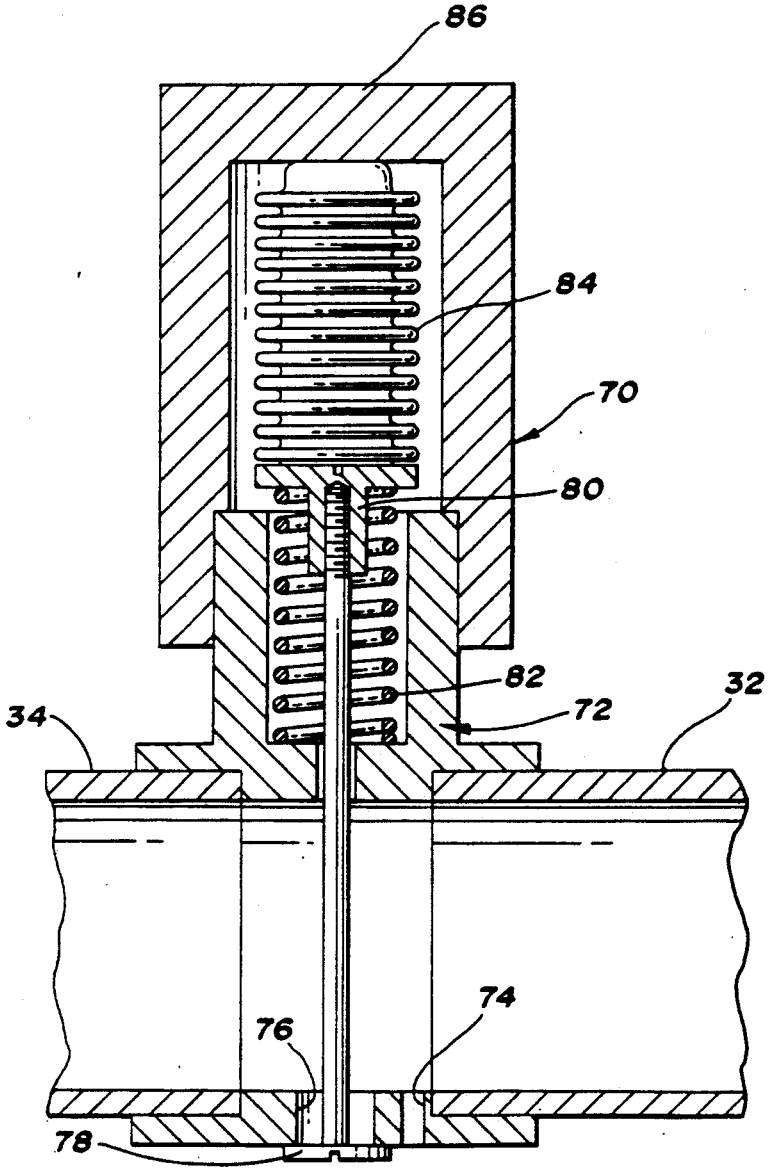
FIG. 4 is an enlarged sectional view of the oil bleed arrangement in FIG. 3.

Another embodiment of the bleed valve arrangement of the present invention is shown in FIGS. 3 and 4. In this embodiment, the bleed valve assembly which is generally designated as 70 includes a valve housing 72 that is generally like that previously described in that it incorporates a conventional bleed hole 74 in addition to a secondary bleed hole 76 that is closed by a bleed valve 78. However, in this case, the valve is connected to an armature 80 contained in the housing that is biased by a coil spring 82, the latter being received about the valve stem and located between the housing and the armature to hold the valve in its normal closed position shown in FIG. 4. And instead of a diaphragm-type power cell, there is in this case provided a sealed bellows 84 that contains vaporized refrigerant. The sealed bellows 84 is connected at its lower end to the top of the armature 80 and finds reaction by having its upper end contained against a cylindrical housing 86 that is sealingly fixed to the cylindrical top of the valve housing 72. Apart from those details described above, the bypass bleed valve 78 operates the same as the bleed valve 38 previously described.

It will thus be appreciated that the foregoing description of the preferred embodiments of the invention have been presented for purposes of illustration and description. It is not intended to be exhaustive or to limit the invention to the precise forms disclosed. Obvious modifications or variations are possible in light of the above teachings. The embodiments were chosen and described to provide the best illustration of the principals of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. An accumulator for an air conditioning system charged with a refrigerant, said accumulator comprising a casing having a bottom and a top, an inlet fitting and an outlet fitting connected to said casing near said top, U-shaped tube means mounted in said casing having an open inlet end located near said top and an outlet end connected to said outlet fitting and a return bend portion located near said bottom, a baffle mounted in said casing between said inlet fitting and said open inlet end, a first lubricant bleed opening in said return bend portion calibrated to allow any lubricant collected in said bottom to enter said tube means at a limited flow rate under normal refrigerant charge conditions, and bleed valve means for establishing a secondary lubricant bleed opening in said return bend in response to a decrease in the amount of refrigerant below a normal charge level to increase the available lubricant flow rate into said tube means.

2. An accumulator for an air conditioning system charged with a refrigerant, said accumulator comprising a casing having a bottom and a top, an inlet fitting and an outlet fitting connected to said casing near said top, U-shaped tube means mounted in said casing having an open inlet end located near said top and an outlet end connected to said outlet fitting and a return bend portion located near said bottom, a baffle mounted in said casing between said inlet fitting and said open inlet end, a first lubricant bleed opening in said return bend portion calibrated to allow any lubricant collected in said bottom to enter said tube means at a limited flow rate under substantial)y normal refrigerant charge conditions, and bleed valve means for establishing a secondary lubricant bleed opening In said return bend in response to a significant increase in the temperature of the refrigerant as occurs in said casing on a significant decrease in the amount of refrigerant below a normal charge level to thereby Increase the available lubricant flow rate into said tube means.

3. An accumulator for an air conditioning system charged with a refrigerant, said accumulator comprising a casing having a bottom and a top, an inlet fitting and an outlet fitting connected to said casing near said top, U-shaped tube means mounted in said casing having an open inlet end located near said top and an outlet end connected to said outlet fitting and a return bend portion located near said bottom, a baffle mounted in said casing between said inlet fitting and said open inlet end, a first lubricant bleed opening in said return bend portion calibrated to allow any lubricant collected in said bottom to enter said tube at a limited flow rate under substantially normal refrigerant charge conditions, and bleed valve means including an expansible vapor charged pressure vessel within said casing for establishing a secondary lubricant bleed opening in said return bend in response to a significant increase in the temperature of the refrigerant in said casing as occurs on a significant decrease in the amount of refrigerant below a normal charge level to thereby increase the available lubricant flow rate into said tube means.

4. An accumulator for an air conditioning system charged with a refrigerant, said accumulator comprising a casing having a bottom and a top, an inlet fitting and an outlet fitting connected to said casing ne ar said top, U-shaped tube means mounted in said casing having an open inlet end located near said top and an outlet end connected to said outlet fitting and a return bend portion located near said bottom, a baffle mounted in said casing between said inlet fitting and said open inlet end, a first lubricant bleed hole in said return bend portion calibrated to allow any lubricant collected in said bottom to enter said tube means at a limited flow rate under substantially normal refrigerant charge conditions, bleed valve means for establishing a secondary lubricant bleed opening in said return bend in response to a significant increase in the temperature of the refrigerant in said casing as occurs on a significant decrease in the amount of refrigerant below a normal charge level to thereby increase the available lubricant flow rate into said tube means, said bleed valve means comprising a secondary bleed hole in said return bend portion, a valve operable to open and close said secondary bleed hole, spring means for normally holding said valve closed, and expansible vapor charged pressure vessel means for opening said valve against said spring means in response to said significant temperature increase.

5. An accumulator as set forth in claim 4 wherein said expansible pressure vessel means comprises a pair of diaphragms and a rigid elongated portion cooperatively forming a sealed chamber charged with refrigerant vapor.

6. An accumulator as set forth in claim 5 wherein said expansible pressure vessel means comprises a sealed bellows charged with refrigerant vapor.

* * * * *